United States Patent [19]

Bechtel et al.

[11] 4,278,419

[45] Jul. 14, 1981

[54] PRIMARY OIL BURNER SAFETY CONTROL AND INTERMITTENT IGNITION SYSTEM

[75] Inventors: Jon H. Bechtel; Frederick J. Geary, both of Holland, Mich.

[73] Assignee: Robertshaw Controls Company, Richmond, Va.

[21] Appl. No.: 34,643

[22] Filed: Apr. 30, 1979

[51] Int. Cl.[3] ..... F23N 5/00

[52] U.S. Cl. ..... 431/24; 431/71; 431/79

[58] Field of Search ..... 431/24, 26, 69, 70, 431/71, 78, 79

[56] References Cited

U.S. PATENT DOCUMENTS

| | | | |
|---|---|---|---|
| 3,672,811 | 6/1972 | Hron | 431/69 |
| 3,751,212 | 8/1973 | Hron | 431/69 |
| 4,024,412 | 5/1977 | MacAskill | 431/79 |
| 4,167,389 | 9/1979 | Donnelly et al. | 431/79 |

*Primary Examiner*—Carroll B. Dority, Jr.

*Attorney, Agent, or Firm*—Malcolm R. McKinnon

[57] ABSTRACT

A primary oil burner safety control and intermittent ignition system for initiating and supervising the combustion of fuel oil in furnaces, the system including thermostatic switch means controlling the energization of a relay having contacts controlling the energization of an oil burner, means constantly monitoring the state of the relay contacts with respect to the state of the thermostatic switch means, and means to effect safety shutdown of the oil burner in the event the state of the relay contacts disagrees with the state of the thermostatic switch means.

7 Claims, 1 Drawing Figure

PRIMARY OIL BURNER SAFETY CONTROL AND INTERMITTENT IGNITION SYSTEM

BRIEF SUMMARY OF THE INVENTION

This invention relates to oil burner safety control and ignition systems, and, more particularly, to an improved primary oil burner safety control and intermittent ignition system particularly adapted for use with oil burners in residential type furnaces. Heretofore, electromechanical safety controls have been utilized to control and supervise oil burners in furnaces, such electromechanical safety controls controlling the furnace oil burner in response to the opening and closing of a thermostatic switch, usually located in the living space of a dwelling or other building, and supervising the furnace oil burner in an effort to insure safe combustion in the furnace's combustion chamber and to shut the burner off if an unsafe condition should occur. However, prior electromechanical safety controls of the indicated character are subject to a deficiency that could result in property damage including outright dwelling destruction and the possibility of death to sleeping occupants. Such deficiency is brought about by the fact that such prior electromechanical controls incorporate a relay having contacts which control the energization of the furnace oil burner, and the relay contacts may fail to open when the relay is deenergized upon opening of the thermostatic switch means. Relay contacts can and do weld or otherwise stick together. Factors contributing to the welding or sticking together of the relay contacts include inductive loads, dislodged armature springs, contact arm metal fatigue, faulty assembly, foreign particle lodgment, misadjustment by inexperienced service men, and miswiring.

The result of the inability of the relay contacts to open when the thermostat has reached the set temperature and the relay is deenergized, as will be described hereinafter in greater detail, is that fuel oil continues to be pumped into the furnace until the furnace bonnet limit switch, or other safety switch, opens. This causes overheating of the building. In a mild climate or at certain seasons of the year when the inside/outside temperature differential is reduced, it may take as long as two hours or more before a well insulated dwelling cools to the original thermostat setting. Moreover, if a tenant is present, such tenant may turn the thermostat setting to a lower temperature thus increasing the cooling time of the dwelling to the thermostat set point. When the furnace bonnet limit switch, or other safety switch, opens, the circuit to the oil pump will be opened, combustion will terminate, and the entire system will be shut down. However, the bonnet limit switch resets automatically, and when the bonnet cools down, as for example in from approximately five to thirty minutes, the bonnet limit switch will close automatically, and since the relay contacts controlling the energization of the oil pump are welded or otherwise stuck together, oil will be pumped into the combustion chamber of the furnace at a rate of approximately 0.5 to two gallons per hour. However, since the dwelling thermostat is open, there can be no ignition. After one, two or more hours, the dwelling thermostat closes, and ignition occurs while the oil pump continues to spray ignited oil into an already saturated or over filled combustion chamber until the bonnet limit switch, or other safety switch, can open again. The consequences of the above described failure will depend on specific conditions, such as temperature differential, limit switch setting and pump capacity. However, it can easily be seen that such a failure may result in severe property damage including outright dwelling destruction and the possibility of serious injury or death to sleeping occupants.

An object of the present invention is to overcome the above described disadvantages of prior electromechanical safety control and ignition systems of the indicated character and to provide an improved oil burner safety control and intermittent ignition system that prevents excess fuel oil from being pumped into the furnace combustion chamber and consequent dwelling temperature rise in the event the power relay contacts fail to open when the thermostatic switch means opens.

Another object of the invention is to provide an improved oil burner safety control and intermittent ignition system which combines electromechanical technology with improved solid state control circuitry in one package to provide improved oil burner safety protection heretofore unobtainable.

Another object of the present invention is to provide an improved safety control and intermittent ignition system which incorporates improved means for constantly monitoring the state of the power relay contacts with respect to the state of the thermostatic switch means, and means to effect safety shutdown in the event the state of the power relay contacts differs with the state of the thermostatic switch means.

Another object of the present invention is to provide an improved primary oil burner safety control and intermittent ignition system which may be readily adapted to meet the control and ignition requirements of various types of oil burners.

Another object of the present invention is to provide an improved oil burner safety control and intermittent ignition system which effects safety shutdown within a predetermined time in the event the power relay contacts fail to open when the thermostatic switch means opens.

Still another object of the present invention is to provide an improved primary oil burner safety control and intermittent ignition system which is economical to manufacture and assemble, durable, efficient and reliable in operation.

The above as well as other objects and advantages of the present invention will become apparent from the following description, the appended claims, and the accompanying drawing.

DETAILED DESCRIPTION

Figure 1:
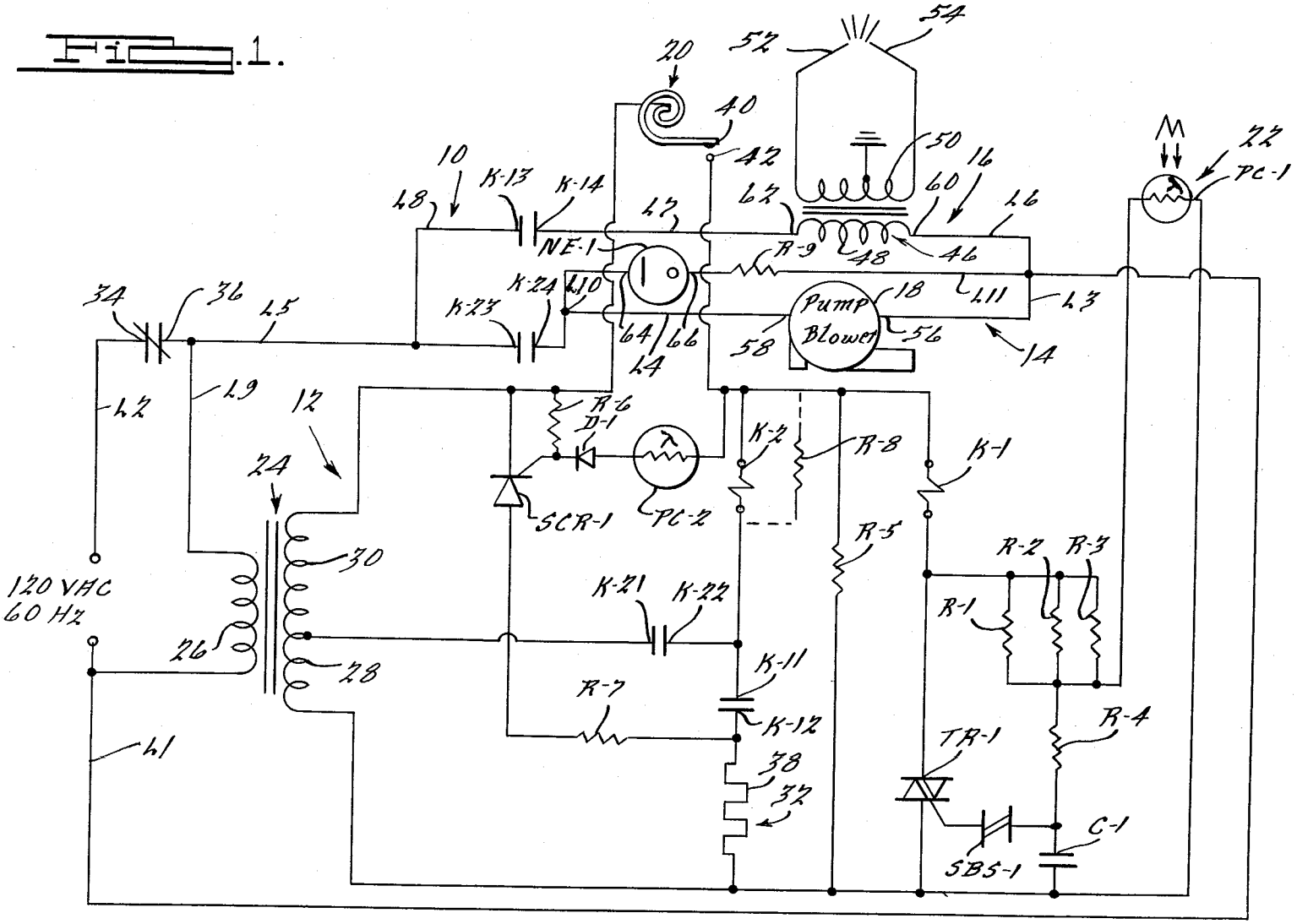
FIG. 1 is a schematic circuit diagram of a primary oil burner safety control and intermittent ignition system embodying the present invention.

Referring to the drawing, a preferred embodiment of the present invention is schematically illustrated therein and is comprised of a primary oil burner safety control and intermittent ignition system, generally designated 10, particularly adapted for use in initiating and supervising the combustion of fuel oil in furnaces of the residential type, although it will be understood that the present invention is applicable to other uses. In the embodiment of the invention illustrated, the system 10 is adapted to be connected to a conventional source of line voltage alternating current, such as conventional nominal 120 volt alternating current. The system 10 includes a low voltage control circuit, generally designated 12, an oil pump/blower motor circuit, generally designated 14, and an ignition circuit, generally designated 16, the various components in the above described circuitry all being electrically connected by suitable conductors as illustrated in the drawing and as will be described hereinafter in greater detail.

The system 10 is adapted to provide control, supervision, intermittent ignition and timed safety shutdown for an oil pump/blower motor 18 connected in the circuit 14. In general, the system 10 operates in the following manner: Line voltage is applied to the system 10 through normally closed safety switch contacts embodied in the system 10. When the room temperature declines below the set point of the thermostat 20, which may be any conventional or desired room type thermostat, the thermostat contacts close. Closure of the thermostat contacts activates the low voltage control circuit 2, and activation of the low voltage control circuit 12 causes line voltage to be applied to the oil pump/-blower motor circuit 14 and the ignition circuit 16. At the same time, safety lockout timing means embodied in the low voltage control circuit 12 is initiated. Upon activation, the ignition circuit 16 initiates a spark discharge across electrodes located in proximity to the oil pump/blower motor 18, and oil particles sprayed by the oil pump/blower motor are caused to ignite and combustion is obtained. Combustion monitoring means 22 embodied in the low voltage control circuit inhibits the safety timing function of the safety timing means embodied in the low voltage control circuit and also interrupts the ignition circuit while maintaining energization of the oil pump/blower motor circuit. In the event of combustion failure, the combustion monitoring means causes immediate activation of the safety timing means and also immediate activation of the ignition circuit 16 again causing spark discharge across the electrodes in an attempt to reestablish combustion. If combustion is reestablished the above logic is repeated. If combustion is not reestablished, safety timing concludes and all voltages are removed from all system components until the safety switch means is reactivated. During normal operation, after combustion is achieved and room temperature rises above the thermostat set point, the thermostat contacts open. Upon opening of the thermostat contacts, line voltage is removed from the oil pump/-blower motor circuit 14 and the ignition circuit 16, and the system assumes a standby state until the next thermostat command. In the event the power relay contacts controlling the energization of the oil pump/blower motor 18 are welded together or otherwise fail to open with the thermostat contacts open, safety timing means removes all line voltage from the oil pump/blower motor circuit 14 within a predetermined time, as for example thirty seconds, after the thermostat contacts open. This prevents both excess oil from being pumped into the combustion chamber and excess dwelling temperature rise.

Referring in detail to the various circuits hereinabove mentioned, the low voltage control circuit 12 is comprised of a step down transformer 24 having a primary winding 26 and secondary windings 28 and 30, the primary winding 26 being adapted to be connected to a conventional source of nominal 120 volt alternating current. The low voltage control circuit 12 also includes a line voltage safety switch, generally designated 32, having normally closed contacts 34 and 36 and a heater coil 38; the conventional thermostat, generally designated 20, having switch means illustrated as contacts 40 and 42; a relay K1 having normally open contacts K-11, K-12 and K-13,K-14; a relay K2 having normally open contacts K-21, K-22 and K-23, K-24; a triac TR-1; and a silicon bilateral switch SBS-1. The low voltage control circuit 12 also includes the combustion monitoring means 22 incorporating a photoelectric cell PC-1; relay contact monitoring means embodying a photoelectric cell PC-2; a silicon controlled rectifier SCR1; a diode D1, resistors R1 through R8; and a capacitor C1.

As shown in the drawing, the low voltage control circuit 12 interfaces between the oil pump/blower motor circuit 14 and the ignition circuit 16 whereby the low voltage control circuit 12 controls and supervises the oil pump/blower motor 18 connected in the circuit 14, and also controls and supervises the ignition means connected in the circuit 16. The oil pump/blower motor circuit 14 includes a light source, such as a neon lamp NE-1, and a resistor R-9 connected in parallel with the oil pump/blower motor 18 while the ignition means includes an ignition transformer 46 having a primary winding 48 and a center tapped secondary winding 50 connected to electrodes 52 and 54 located in proximity to the oil pump/blower motor 18 whereby oil particles sprayed by the oil pump/blower motor 18 will be ignited by a spark discharge across the electrodes 52 and 54.

The terminal 56 of the oil pump/blower motor 18 is connected to one conductor L1 of the source of power by the lead L3 while the terminal 58 is connected to the other conductor L2 of the source of power by the lead L4 through the normally open contacts K-23, K-24 and the lead L5. The terminal 60 of the primary winding 48 of the ignition transformer 46 is connected to the lead L1 by the lead L6 while the terminal 62 of the primary winding of the ignition transformer 46 is connected by the lead L7 through the normally open contacts K-13, K-14 to the lead L5 by the lead L8. The normally closed contacts 34 and 36 of the safety switch 32 are connected to and adapted to make and break the line voltage lead L2 connected to the primary winding 26 of the transformer 24 by the lead L9 whereby all electrical power to the circuits 12, 14 and 16 is interrupted when the contacts 34 and 36 open.

The safety switch 32 may be of the type disclosed in U.S. Pat. No. 3,848,211 issued Nov. 12, 1974 and assigned to the assignee of the present invention, in which at least one of the contacts 34 or 36 is actuated by a bimetallic member and in which energization of the heater coil 38 for a predetermined period of time is effective to open the contacts 34 and 36 by heating the bimetallic member, as for example, for a period of approximately 30 seconds. Opening of the contacts 34 and 36 breaks the line voltage to the circuits 12, 14 and 16, it being preferred that the contacts 34 and 36 open approximately 30 seconds after attempted ignition of the oil with 120 VAC nominal line voltage input. Thus, if combustion does not occur within such predetermined time, the contacts 34 and 36 open thereby deactivating all circuits for safety shut down purposes. It will also be understood that a bimetallic switch of the type hereinabove mentioned is trip-free and may be reset by a push button after a cool down period has elapsed. If desired, other types of safety switches may be utilized.

The series combination of the neon lamp NE-1 and resistor R9 are connected in parallel with the oil pump/-blower motor 18, the terminal 64 of the neon lamp NE-1 being connected to the lead L4 between the relay contact K-24 and the terminal 58 of the oil pump/-blower motor 18 by the lead L10 while the terminal 66 of the neon lamp NE-1 is connected through the resistor R9 to the junction of the leads L1 and L3 by the lead L11. Thus, the neon lamp NE-1 lights whenever there is power to the burner subsystem and the contacts K-23, K-24 are closed.

The neon lamp NE-1 is positioned in a manner such that light emanating from the neon lamp impinges upon the photoelectric cell PC-2, the neon lamp NE-1 and the photoelectric cell PC-2 thus forming an optical coupler between the low voltage control circuit 12 and the oil pump/blower motor circuit 14 independent of the ignition circuit 16. As shown in the drawing, the photoelectric cell PC-2 is connected in series with the diode D1 and connected to the parallel combination of the resistor R6 and the gate of the silicon controlled rectifier SCR1.

The triac TR-1 is a bidirectional thyrister which may be gate triggered from a blocking to a conducting state for either polarity of applied voltage, and is preferably mounted to isolate the other components of the system from the heat generated by the triac TR-1.

Assuming a basic knowledge of the triac TR-1, the photoelectric cells PC-1 and PC-2, and the silicon bilateral switch SBS-1, the system 10 operates in the following manner in a typical thermostat cycle. The thermostat switch contacts 40 and 42 close in response to a thermostat heat call signal. The photoelectric cell PC-1 is positioned in a manner such that it can "see" the combustion area adjacent the oil pump/blower motor 18, and in a typical cycle, the initial condition of the photoelectric cell PC-1 at the instant of thermostat contact closure will be in the "dark" or high resistance mode. The parallel resistors R1, R2 and R3 form a series parallel voltage divider along with the photoelectric cell PC-1. If the photoelectric cell resistance is high, (dark start condition), sufficient voltage is developed across the photoelectric cell PC-1, the resistor R4 and the capacitor C1 to exceed the breakover voltage of the silicon bilateral switch SBS-1, at which time the capacitor C1 will discharge into the gate of the triac TR-1 allowing the triac to conduct thereby causing the relay K1 to energize. On the other hand, if the resistance of the photoelectric cell PC-1 is too low, (light start condition), the silicon bilateral switch will not breakover. The cross over point of the photoelectric cell PC-1 is preferably adjusted to a nominal 5K ohms by adjusting the value of the resistors R1, R2 and R3.

When the relay K1 is energized, closure of the contacts K-13, K-14 causes line voltage to be applied to the primary winding 48 of the ignition transformer 46. At the same time, closure of the contacts K-11, K-12 causes secondary voltage from the transformer 24 to be applied to the relay K2 and the heater coil 38 of the line voltage safety switch 32. It is preferred that the relay K2 pull in if the line voltage is over 87 VAC. Closure of the contacts K-21, K-22 latches the relay K2 on while closure of the contacts K-23, K-24 applies voltage to the oil pump/blower motor 18 and the parallel neon lamp NE-1 and resistor R9. Thus the oil pump/blower motor 18 and the ignition circuit 16 are energized to establish ignition. As previously mentioned, the neon lamp NE-1 is optically coupled to the photoelectric cell PC-2 which is in series with the diode D1 and connected to the parallel combination of the resistor R6 and the gate of the silicon controlled rectifier SCR1. This network is essentially shorted out by the closed thermostat contacts.

Since both oil flow and ignition are present, combustion will occur and the photoelectric cell PC-1, monitoring the combustion chamber, will "see" light and the resistance of the photoelectric cell PC-1 will fall below the breakover voltage of the silicon bilateral switch SBS-1. The triac TR-1 will then cease conduction and the relay K1 will be deenergized. Deenergization of the relay K1 will cause the contacts K-11, K-12 and K-13, K-14 to open thereby deenergizing the ignition transformer 16 and the heater coil 38 of the safety switch 32. Thus the ignition circuit and the safety timing circuit are interrupted while energization of the oil pump/-blower motor circuit is mantained. In the event combustion should cease in midcycle, the voltage of the capacitor C1 would increase so as to turn on the silicon bilateral switch SBS-1 and the triac TR-1 in the manner previously described. Hence ignition would immediately resume due to closure of the contacts K-13, K-14, and safety timing would resume due to closure of the contacts K-11, K-12.

In the event flame does not appear when desired in the typical cycle discussed hereinabove, the safety switch heater 38 will continue to heat and eventually trip the manual reset contacts 34 and 36 to the open state. Because the contacts 34 and 36 in the open condition break power to the transformer 24, all control power connected to the secondary windings 28 and 30 of the transformer 24 is cut off. Such power cut off deenergizes the relays K1 and K2, the triac TR-1, the silicon bilateral switch SBS-1, and the capacitor C1 which has the effect of opening the contacts of the relays K1 and K2. Opening of the contacts 34 and 36 also prevents any power from going to any load because the lead L2 is open and the circuits 14 and 16 are deenergized. Hence the contacts 34 and 36 provide an extra margin of safety.

At the end of the heating cycle, the contacts 40 and 42 of the thermostat will open and the entire low voltage control circuit 12 will be deenergized. Deenergization of the relay K2 will cause the contacts K-23, K-24 to open thereby removing voltage from the oil pump/-blower motor 18, and the neon lamp NE-1 and associated resistor R9. If the contacts of the relay K2 fail to open when the thermostat contacts 40 and 42 open, voltage will continue to be applied to the oil pump/-blower motor 18, the neon lamp NE-1, and the resistor R9. Since the photoelectric cell PC-2 is optically coupled to the neon lamp NE-1, and since the thermostat contacts 40 and 42 are open, the silicon controlled rectifier SCR1 will be gated on through the diode D1, the photoelectric cell PC-2 and the resistor R5, and current will flow through the silicon controlled rectifier SCR1, the resistor R7 and the heater coil 38 of the safety switch 32 thereby causing the safety switch contacts 34 and 36 to open thus removing line voltage from the entire system within a predetermined time, such as 30 seconds.

The diode D1 serves to prevent negative voltage from being applied to the gate of the silicon controlled recitifer SCR1 and also serves to prevent accidental triggering of the silicon controlled rectifier SCR1 by any voltage developed across an anticipator that may be incorporated in the thermostat 20. The resistor R5 serves both to trigger the silicon controlled rectifier gate and allow charging current for the battery in a time variable thermostat such as the time variable thermostat disclosed in U.S. Pat. No. 3,948,441 issued Apr. 6, 1976 and assigned to the assignee of the present invention. The resistor R8 may be incorporated in the system to provide any desired anticipation current for thermostats requiring such an electrical current.

Typical values for the components in the system described hereinabove are as follows:

R1—24K ohm—$\frac{1}{4}$ W—Carbon Film
R2—75K ohm—$\frac{1}{4}$ W—Carbon Film
R3—200K ohm—$\frac{1}{4}$ W—Carbon Film
R4—1K ohm—$\frac{1}{4}$ W—Carbon Film
R5—8.2K ohm—$\frac{1}{4}$ W—Carbon Film
R6—470 ohm—$\frac{1}{4}$ W—Carbon Film
R7—24 ohm—2 W—Wire Wound
R8—60 ohm—10 W—Wire Wound
R9—100K ohm—$\frac{1}{4}$ W—Carbon Film
38—22 ohm—1 W—Wire Wound
C1—0.1 MFD—100 VDC—Mylar
K1—K2—Relay—047-2
SBS-1—2N4991—or equivalent
SCR1—C-106A—or equivalent
TR-1—MAC-92-3—or equivalent
D1—IN4148 or equivalent
PC1-PC2—VT-730
NE-1—NE2U or equivalent It will be understood however, that these values may be varied depending upon the particular application of the principles of the present invention.

While a preferred embodiment of the invention has been illustrated and described, it will be understood that various changes and modifications may be made without departing from the spirit of the invention.

What is claimed is:

1. A primary safety control system for an oil burner, said system comprising, in combination, a high voltage circuit connected to said oil burner, a low voltage control circuit including a relay having contacts in said high voltage circuit controlling the energization of said oil burner, thermostatic switch means in said low voltage control circuit controlling the energization of said relay, means monitoring the open and closed state of said relay contacts with respect to the open and closed state of said thermostatic switch means, and means effective to open said high voltage circuit when the state of said relay contacts differs with respect to the state of said thermostatic switch means, said monitoring means including an optical coupler comprising a light source and a photoelectric cell, said light source being connected to said high voltage circuit in parallel with said oil burner, said photoelectric cell being connected in said low voltage control circuit.

2. A primary safety control system for an oil burner, said system comprising, in combination, a high voltage circuit connected to said oil burner, a low voltage control circuit including a relay having contacts in said high voltage circuit controlling the energization of said oil burner, thermostatic switch means in said low voltage control circuit controlling the energization of said relay, means monitoring the open and closed state of said relay contacts with respect to the open and closed state of said thermostatic switch means, and means effective to open said high voltage circuit when the state of said relay contacts differs with respect to the state of said thermostatic switch means, said monitoring means including a light source and a network comprising a photoelectric cell, a diode connected in series with said photoelectric cell and a resistor, a silicon controlled rectifier having a gate, said network being connected in parallel with said thermostatic switch means and in series with said gate, said light source being connected to said high voltage circuit in parallel with said oil burner and in series with said contacts.

3. A safety control and intermittent ignition system for an oil burner, said system comprising, in combination, a high voltage circuit connected to said oil burner, a low voltage control circuit including a relay having contacts in said high voltage circuit controlling the energization of said oil burner, combustion initiation means connected to said high voltage circuit, means in said low voltage control circuit including thermostatic switch means effective to actuate said relay and said combustion initiation means, means monitoring the open and closed state of said relay contacts with respect to the open and closed state of said thermostatic switch means, and means effective to open said high voltage circuit when the state of said relay contacts differs with respect to the state of said thermostatic switch means, said monitoring means including an optical coupler, said optical coupler comprising a light source and a photoelectric cell, said light source being connected to said high voltage circuit in parallel with said oil burner, said photoelectric cell being connected in said low voltage control circuit in parallel with said thermostatic switch means.

4. A primary safety control system for an oil burner, said system comprising, in combination, a high voltage circuit connected to said oil burner, a low voltage control circuit including a relay having contacts in said high voltage circuit controlling the energization of said oil burner, thermostatic switch means in said low voltage control circuit controlling the energization of said relay, means monitoring the open and closed state of said relay contacts with respect to the open and closed state of said thermostatic switch means, and means controlled by said monitoring means and effective to open both said high voltage circuit and said low voltage control circuit when the state of said relay contacts differs with respect to the state of said thermostatic switch means, said monitoring means including an optical coupler comprising a light source and a photoelectric cell, said light source being connected to said high voltage circuit in parallel with said oil burner and in series with said contacts, said photoelectric cell being connected in said low voltage control circuit in parallel with said thermostatic switch means.

5. A primary safety control system for an oil burner, said system comprising, in combination, a high voltage circuit connected to said oil burner, a low voltage control circuit including a relay having contacts in said high voltage circuit controlling the energization of said oil burner, thermostatic switch means in said low voltage control circuit controlling the energization of said relay, means monitoring the open and closed state of said relay contacts with respect to the open and closed state of said thermostatic switch means, and means controlled by said monitoring means and effective to open both said high voltage circuit and said low voltage control circuit when the state of said relay contacts differs with respect to the state of said thermostatic switch means, said monitoring means including a light source and a network comprising a photoelectric cell, a diode connected in series with said photoelectric cell and a resistor, a silicon controlled rectifier having a gate, said network being connected in parallel with said thermostatic switch means and in series with said gate, said light source being connected to said high voltage circuit in parallel with said oil burner and in series with said contacts.

6. A safety control and intermittent ignition system for an oil burner, said system comprising, in combination, a high voltage circuit connected to said oil burner, a low voltage control circuit including a relay having contacts in said high voltage circuit controlling the energization of said oil burner, combustion initiation means connected to said high voltage circuit, said low voltage control circuit including ignition detection means, means in said low voltage control circuit including thermostatic switch means effective to actuate both said relay and said combustion initiation means, means monitoring the open and closed state of said relay contacts with respect to the open and closed state of said thermostatic switch means, and means effective to open both said high voltage circuit and said low voltage control circuit when the state of said relay contacts differs with respect to the state of said thermostatic switch means, said low voltage control circuit including a triac controlling the energization of said combustion initiation means, a silicon bilateral switch controlling the actuation of said triac, said ignition detection means controlling the actuation of said silicon bilateral switch, said monitoring means including an optical coupler, said optical coupler comprising a light source and a photoelectric cell, said light source being connected to said high voltage circuit in parallel with said oil burner and in series with said contacts, said photoelectric cell being connected in said low voltage control circuit in parallel with said thermostatic switch means.

7. The combination as set forth in claim 6, said light source being in the form of a neon lamp, and a resistor connected in series with said neon lamp.

* * * * *